US006398881B1

(12) United States Patent
Brenner et al.

(10) Patent No.: US 6,398,881 B1
(45) Date of Patent: Jun. 4, 2002

(54) WEAR-RESISTANT CAMSHAFT AND METHOD OF PRODUCING THE SAME

(75) Inventors: Berndt Brenner, Pappritz; Carsten Duschek; Andreas Wetzig, both of Dresden; Dietmar Naunapper, Oberrimsingen, all of (DE)

(73) Assignee: Fraunhofer-Gesellschaft zur Förderung der Angewandten Forschung e.V., München (DE)

( * ) Notice: Subject to any disclaimer, the term of this patent is extended or adjusted under 35 U.S.C. 154(b) by 0 days.

(21) Appl. No.: 09/254,704

(22) PCT Filed: Sep. 12, 1997

(86) PCT No.: PCT/DE97/02072

§ 371 Date: May 19, 1999

(87) PCT Pub. No.: WO98/11262

PCT Pub. Date: Mar. 19, 1998

(30) Foreign Application Priority Data

Sep. 13, 1996 (DE) ..... 196 37 464

(51) Int. Cl.[7] ..... C21D 1/09; C21D 1/10; C22C 37/00

(52) U.S. Cl. ..... 148/321; 148/512; 148/612; 148/639; 148/565; 148/566; 148/567; 148/902

(58) Field of Search ..... 148/512, 612, 148/639, 565, 566, 567, 320, 321, 902

(56) References Cited

U.S. PATENT DOCUMENTS

| | | | | |
|---|---|---|---|---|
| 3,838,288 A | * | 9/1974 | Stolz et al. | 148/512 |
| 4,545,825 A | | 10/1985 | Miyata et al. | |
| 4,652,724 A | | 3/1987 | Morita et al. | |
| 4,905,538 A | * | 3/1990 | Watanabe et al. | 74/567 |
| 5,238,509 A | | 8/1993 | Kusunoki | |
| 5,705,788 A | * | 1/1998 | Beyer et al. | 148/512 |

FOREIGN PATENT DOCUMENTS

| | | |
|---|---|---|
| DE | 3916684 | 11/1990 |
| DE | 4132277 | 4/1992 |
| DE | 4237484 | 5/1994 |
| DE | 4309870 | 9/1994 |
| EP | 0161624 | 11/1985 |
| EP | 0194506 | 9/1986 |
| EP | 0601451 | 6/1994 |

OTHER PUBLICATIONS

K. Heck, "Einfluss der Prozessführung beim Umschmeizhärten auf die Randschichteigenschaften von Nockenwellen aus ledeburitischem Gusseisen", dissertation, Münich (Jul., 1983).

M. Mordike, "Grundlagen und Anwendung der Laseroberflächen–behandlung von Metallen." Dissertation, Clausthal–Zellerfled, (Jul., 1991).

KH.G Schmitt–Thomas et al., "Einfluss der Prozessführung beim Umschmelzhärten auf die Randschichteigenschaften von Nockenwellen aus ledeburitischem Gusseisen," Haerterei Technische Miteilungen, Bd. 38. Nr. 2 (Mar. 1983).

* cited by examiner

*Primary Examiner*—Deborah Yee
(74) *Attorney, Agent, or Firm*—Greenblum & Bernstein, P.L.C.

(57) ABSTRACT

The invention concerns a wear-resistant camshaft and a method of producing the same. Objects in which the application of the invention is possible and useful are all cast-iron parts which are subject to wear as a result of lubricated friction. The wear-resistant camshaft consists of cast-iron and it has a surface layer consisting of a ledeburitic remelted layer with a high cementite portion, and, lying thereunder, a martensitic hardening zone, whereby according to the invention.

a. the remelted layer consists of finely dispersed ledeburitic cementite with thicknesses of $\leqq 1$ $\mu$m and a metallic matrix of a phase mixture of martensite and/or bainite, residual austenite, as well as less than 20% finely laminated pearlite with a distance of $\leqq 0.1$ $\mu$m between the lamelias, and b. the hardening layer is formed from a phase mixture of martensite and/or bainite, partially dissolved pearlite, and residual austenite.

This wear-resistant camshaft according to the invention is produced by means of a high-energy surface remelting method.

26 Claims, 2 Drawing Sheets

A SCHEMATIC REPRESENTATION OF THE TEMPERATURE TIME CYCLE ACCORDING TO THE INVENTION

A SCHEMATIC REPRESENTATION OF THE TEMPERATURE TIME CYCLE ACCORDING TO THE INVENTION

A SCHEMATIC COMPARISON OF THE TEMPERATURE TIME CYCLE ACCORDING TO THE INVENTION WITH THE TEMPERATURE TIME CYCLES KNOWN FROM THE PRIOR ART

WEAR-RESISTANT CAMSHAFT AND METHOD OF PRODUCING THE SAME

BACKGROUND OF THE INVENTION

1. Field of the Invention

The invention concerns the production of highly wear-resistant ledeburitic surface layers of cast-iron machine components. The present invention is useful in all cast-iron components subject to wear as a result of lubricated friction. The invention is particularly advantageous for use in the production of engine components, such as camshafts, cam followers, rocker arms, cylinder liners, or the like.

2. Discussion of Background Information

Ledeburitic surface layers have very good wear resistance to sliding friction under hydrodynamic or mixed friction conditions.

It is known to produce such layers for camshafts by TIG remelting (e.g., Heck: Influence of Process Control in Remelt Chilling on the Surface Layer Properties of Camshafts Made of Ledeburitic Cast Iron, Dissertation, Munich, 1983). For this, a TIG burner is guided relatively slowly at approximately 125 to 225 mm/min at a right angle to the feed direction with a low oscillation frequency of approximately 0.7 to 2.2 Hz in pendulum fashion along the camshaft circumference. The power density used is roughly 3000 W/cm$^2$. Thus, heating speeds of approximately 200–750 K/s are achieved. In order to avoid cracks, preheating to temperatures of approximately 400° C. is used.

The cams produced in this fashion have a coarse solidification structure which consists of relatively coarse ledeburitic cementite and pearlite in the metal matrix. Moreover, tempered zones are generated which are characterized by unfavorable damage to the remelted structure because of repeated temperature loading as a result of the slow pendulum action of the TIG burner.

A disadvantageous effect with cams produced in this manner is the fact that wear resistance is too low. The cause of the low wear resistance lies in the coarse grain structure and the additional coarsening of the structure within the tempered zones.

The major shortcoming of the method is that the solidification speed is too slow. The cause for this consists in the power density is too low, which makes it necessary to work with relatively low feed rates.

To counter this shortcoming, it is known to also use modern high-energy surface layer remelting methods such as laser beam remelting (e.g.: M. S. Mordike: "Principles and Application of Laser Surface Refinement of Metals", Dissertation, Clausthal-Zellerfeld, 1991; Patent DE 42 37 484) or electron beam remelting (e.g., Patent DE 43 09 870) for ledeburitic remelting of camshafts. For this, an appropriately shaped energy beam (e.g., rectangular; two rectangular radiation fields separated in the feed direction; scanning spot grids; grids with different power densities) with a feed rate which is constant or a function of the local radius curvature is guided over the camshaft such that one melting pool extending over the entire width of the cam is created, or a plurality of melting pools extending only slightly in the feed direction. Here, power densities of $10^3$ to $10^5$ W/cm$^2$ are used. The feed rates are 500 to 2500 mm/min. To avoid cracks in the melt zones, it seemed indispensable to use intensive preheating to temperatures of approximately 360 to 550° C. This occurs as a rule in expensive through-type furnaces.

The remelted cam regions have a remelted zone 0.3 mm to an average of approximately 0.8 mm deep. The remelted zone includes ledeburitic cementite and pearlite in the metallic matrix. When the austenitizing temperature is exceeded in the zone directly below the remelted zone, a new pearlitic zone of slightly higher hardness than that of the starting state is formed because of the slow cooling. The drop in hardness begins, consequently, immediately at the edge of the remelted zone and is relatively steep.

The shortcoming of cams produced in this manner is that they do not achieve the actual wear resistance possible for such a finely dispersed structural formation of the ledeburitic cementite. The reason for this is that the pearlite in the metallic matrix has lower wear resistance than the cementite and, consequently, represents the weak point of structure.

The shortcoming of the method is that pearlite develops both within the remelted zone and in the underlying new austenitizing zone. The cause for this is that, due to the high preheating temperatures of 360° C. to 550° C., the cooling speed in the temperature range of approximately 600° C. to 450° C. is already so low despite the high solidification speed that the residual austenite breaks down completely to form relatively coarse pearlite.

However, an optimum surface layer structure for wear resistance requires a layer structure consisting of a thin surface layer which is capable of accommodating the adhesive stresses occurring with tribologic loading, plastic deformations, and cyclic elastic-plastic microstrains, and an underlying support layer which accommodates the strains as a result of Herzian stresses. Consequently, an additonal shortcoming of this method is that this support layer can also only be formed by a remelted layer. The greater remelting depth necessary for this results in economic disadvantages due to the low feed rate required.

A cam with a surface layer structure better suited for wear resistance became known with patent EP 0 161 624. The cam surface layer includes a cementite layer with a large proportion of cementite and, under it, a martensitic layer, whereby the remelted layer has a depth of 0.3 to 1.5 mm and the underlying hardening zone has a thickness of 0.3 to 2.0 mm.

In this method, the cams, without preheating are brought to melting by a TIG arc and then solidify by self-quenching. In a subsequent patent (EP 0 194 506), to accelerate the cooling, water or a water air mixture is passed through the central oil bore in the lengthwise axis of the camshaft.

It is possible, without consequences for crack formation, to do without preheating, since the work is performed with a very low power of 1360–2600 W at very low rotational speeds of 0.7 to 1.0 rpm. This corresponds approximately to feed rates of 80 to 130 mm/min. At these slow feed rates, the heat introduced runs in front of the remelting spot and also penetrates very deeply into the cam during the remelting. Thus, the quenching speed is reduced so much that the crack formation stress is no longer reached during cooling. However, because of the low feed rate, the solidification speed is also reduced, which results in a coarser formation of the ledeburitic cementite compared to laser or electron beam remelted cams.

Despite the low cooling speed, cams treated in this manner have improved wear resistance compared with the TIG remelted cams with preheating. The only reason for this can be that the pearlite formed in the metallic matrix is clearly more finely laminated because of the higher cooling speed during its creation. The potential of possible improvement of properties due to a finely dispersed cementite formation can, however, not be realized.

Consequently, the shortcoming of cams produced in this manner is that they have no wear-optimal surface layers. The cause of this is the relatively coarse formation of the solidification structure as a result of the low solidification speed and the formation of tempered zones.

The low power density and slow feed rate result in a solidification speed too low for the formation of a finely dispersed structure. Another disadvantage is that the structure is macroscopically non-homogeneous and periodically has even coarser grain structures. The reason is the repeated local temperature exposure of already greatly cooled regions to far above the austenitizing temperature as a result of the vary low oscillation motion of the TIG burner.

SUMMARY OF THE INVENTION

The present invention provides a camshaft better protected against wear caused by sliding friction as well as a method for production thereof.

The invention further reports formation of a grain structure and a surface layer structure for camshafts and similarly loaded cast-iron components which are better suited to the use conditions of sliding friction loads with high load stresses under hydrodynamic or mixed friction conditions. Also, a method provided which works to establish finely dispersed structures with high power densities, avoids crack formation even without volume preheating, and at the same time essentially suppresses the formation of coarse pearlite by a relatively high cooling speed between 600° C. and 350° C.

According to the invention, a wear resistant cast-iron camshaft, is provided whose surface layer includes a ledeburitic remelted layer with a high cementite proportion and a martensitic hardening zone underlying it.

The remelted layer includes finely dispersed ledeburitic cementite with thicknesses $\leqq 1$ $\mu$m and a metallic matrix of a phase mixture of martensite and/or bainite, residual austenite as well as less than 20% of finely laminated pearlite with a distance of <0.1 $\mu$m between lamellas. The underlying hardening layer includes a phase mixture of martensite and/or bainite, paritally dissolved pearlite, as well as residual austenite. The remelted layer can have a depth $t_s$ of 0.25 mm$\leqq t_s \leqq$0.8 mm and the hardening layer can have a depth of 0.5 mm$\leqq t_s \leqq$1.5 mm.

The depths $t_s$ of the remelted layer of the present invention are somewhat smaller than known in the prior art and thus use the supporting effect of the underlying layer in an economically advantageous manner.

In addition, the present invention provides a method for production of the wear-resistant camshaft using a high-energy remelting method. The method produces a wear-resistant camshaft by a high-energy surface remelting process. A temperature time curve of the remelting includes two superposed short-time temperature time cycles $T_1$ and $T_2$, which are generated with two different energy sources $S_1$ and $S_2$ with different power densities $p_1$ and $P_2$. The temperature time cycle $T_1$ has a peak temperature $T_{1max}$ of 560° C.$\leqq T_{1max} \leqq$980° C., a heating time of 0.5 s$\leqq t_1 \leqq$6 s, an average heating speed of $(\Delta T_{1maxc}/\Delta t_{1c})$ of 90 K/s$\leqq$ $(\Delta T_{1maxc}/\Delta t_{1c}) \leqq$1900 K/s and an initial quenching speed $(\Delta T_{1a}/\Delta t_{1a})$ of 50 K/s$\leqq(\Delta T_{1a}/\Delta t_{1a}) \leqq$500 K/s and the power density $p_1$ of the energy source $S_1$ reaches the value of $8\times10^2$ W/cm$^2 \leqq p_1 \leqq 8\times103$ W/cm$^2$. The temperature time cycle $T_2$ has a peak temperature $T_{2max}$ of $T_{2max} \geqq T_s$, whereby $T_s$ represents the melting temperature of the cast-iron used, an average heating speed $(\Delta T_{2maxc}/\Delta t_{2c})$ of 3000 K/s$\leqq$ $(\Delta T_{2maxc/\Delta t2c}) \leqq$40,000 K/s, a solidification speed $v_s$ of the melt of 10 mm/s$\leqq$vs$\leqq$67 mm/s as well as a power density $p_2$ of the energy source $S_2$ of $0.8\times10^4$ W/cm$^2 \leqq p_2 \leqq 8\times10^4$ W/cm$^2$ is selected. The time period $t_{21}=t_2-t_1$ after the temperature time cycle $T_2$ begins is 0.3 s$\leqq t_{21} \leqq$11 s. The temperature $T_{1min}$ at which the temperature time cycle begins is $T_{1min}$>500° C.; the melting pool life $t_s$ is in the range of values from 0.08 s$\leqq \Delta t_s \leqq$0.8 s; and the feed rate $v_B$ of the high-energy energy source $S_2$ reaches the value of 600 mm/min$\leqq v_B \leqq$4000 mm/min.

The entire width of the camshaft can be melted in one rotation. The necessary power density distribution $p_2$ may be generated at a right angle to the feed direction by a rapid beam oscillation, in which the oscillation frequency is at least 200 Hz. The high-energy energy source $S_2$ can be a laser. The rapid beam oscillation can include a rapid temporal and periodic sequence of a plurality of harmonic oscillation packets of different frequency f, amplitude A, center position $A_o$, and periodicity $n_p$. In this manner the number of different oscillation packets may be between 1 and 8, and periodicity is selected at $1 \leqq n_p \leqq 20$. The energy source $S_1$ can be a medium-frequency induction generator. The high-energy energy source $S_2$ can be an electron beam.

In accordance with the exemplary embodiments, the energy source $S_1$ can be an electron beam. The high-energy energy source $S_2$ may be high-performance diode laser. The energy source $S_1$ may also be a high-performance diode laser. Further, the energy source $S_1$ may include a plurality of high-performance diode lasers arranged in rotational symmetry around the camshaft and the camshaft can be preheated in the stationary process. Cementite stabilizing elements may be added to the melt in the casting of the camshaft. Austenite stabilizing elements may be added to the melt in the casting of the camshaft. Still further, cementite and/or austenite stabilizing elements can be added to the melt during the surface layer remelting with the high-energy energy source $S_2$.

By the superposing of two short-time temperature cycles T1 and T2 it is possible to solve the contradiction which has existed previously the requirement for a high solidification and quenching speed as well as a relatively high and adjustable cooling speed between 600° C. and 350° C., on the one hand and the requirement for a low cooling speed below approximately 300° C.

Thus, on the one hand, a finely dispersed solidification structure as well as a finely dispersed cycle of solid transformations with a controllable and relatively strong suppression of the formation of coarse pearlite is possible. On the other hand, the cooling speed in the crack-critical temperature range is adequately low to avoid cracks.

An advantage of some embodiments of the present invention is the fact that tempered zones as a result of excessive temperature fluctuations during remelting can be avoided.

An advantage of other embodiments of the present invention is the fact that because of a fast beam oscillation, the dimensions of the energy beam in the feed direction and perpendicular thereto can be set relatively flexibly and independent of each other and that with the oscillation frequencies reported, the temperature oscillations are small enough to prevent tempered zones. Thus, even with wide camshafts, short melting pool lives can be achieved.

Another advantage of embodiments of the present invention is the fact that power density distribution of the energy beam can be adapted to the heat dissipation conditions which differ toward the edge of the cam and the effects of the surface tension of the melt.

In accordance with the present invention, favorable energy sources for $S_1$ and $S_2$ include laser, medium-frequency induction generator, electron beam, high-performance diode laser, and a plurality of high-performance diode lasers arranged in rotational symmetry around the camshaft.

Another advantage of the present invention is the fact that with relatively slight changes of the chemical composition of the cast iron, the structure formation essential for the sliding friction wear characteristics can clearly be altered.

Another advantage of the present invention is that these slight changes in the chemical composition can also be integrated into the process.

BRIEF DESCRIPTION OF DRAWINGS

The invention is explained in detail in reference to the following exemplary embodiment.

In the associated drawings, the superposing of two short-time temperature cycles (FIG. 1) and a schematic comparison of the temperature time curve according to the invention with those known in the prior art (FIG. 2) are depicted.

DETAILED DESCRIPTION OF THE PRESENT INVENTION

EXAMPLE 1

A camshaft made of cast iron with a chemical composition 2.5 . . . 3.2% C; 1.6 . . . 2.5% Si; 0.3 . . . 1.0% Mn; ≦0.2% P; ≦0.12% S; ≦0.6% Cu; ≦0.15% Ti; ≦0.2% Ni; ≦0.3% Cr; ≦0.3% Mo; $S_c$≦0.9 is to be provided with an optimally wear-resistant and economically producible surface layer. The camshaft diameter is 36 mm and the camshaft width is 14 mm. The hardness of the starting structure is 250 HV 0.05. The graphite formation is in layers; the matrix almost completely pearlitic.

Figure 1:
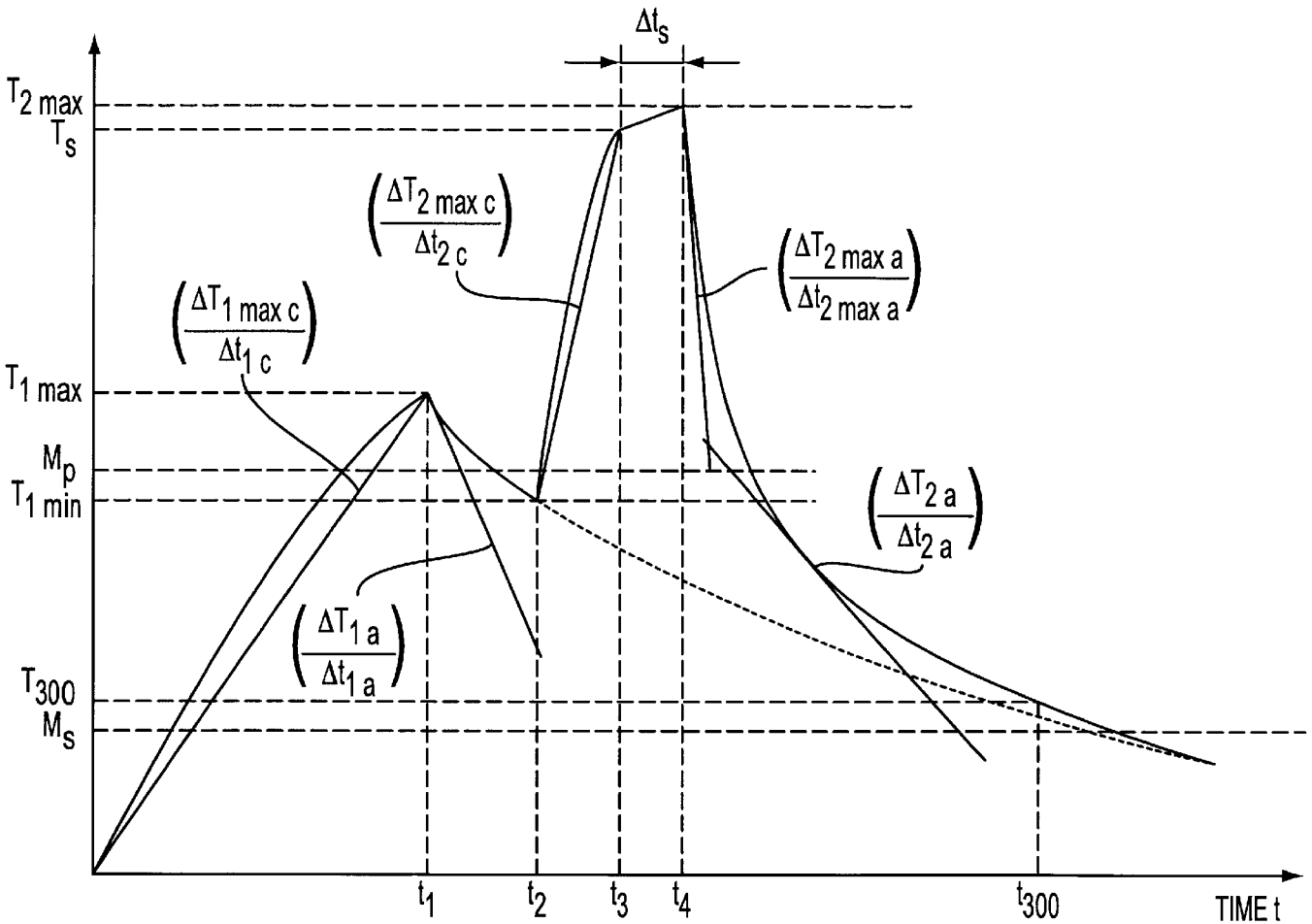

FIG. 1 schematically depicts the temperature time curve realized. An inductive application of energy is selected as the method for generating the temperature time cycle T1. The generator is an MF generator and has a frequency of 10 kHz. The inductor is a single-winding ring inductor with a winding strength of 8 mm×8 mm and a coupling distance of 2.0 mm.

A 5.0 kW $CO_2$ laser serves as the energy source to generate the temperature time cycle T2. The laser beam is focused with an off-axis parabolic mirror with a focal length of 400 mm. In the partially focused beam region, there is a scanning mirror which oscillates with a frequency of f=200 Hz at a right angle to the feed direction of the laser beam. The cam surface is 30 mm outside the focus. The oscillation amplitude is A=6 mm with a triangular law of vibration.

After the camshaft is clamped in, it is moved at a rotational speed of 300 rpm. The induction generator is set to a power of 70 kW. The power density $p_1$ is 4000 W/cm$^2$. Then, a generator is turned on for a period of $t_1$=1.0 s.

At an average heating speed of $(\Delta T_{1maxc}/\Delta t_{1c})$≈700 K/s a peak temperature $T_{1max}$≈700° C. is reached.

After a period $t_{21}$=0.9 s, during which the surface cools to a temperature $T_{1min}$≈550° C., the laser is powered on as energy source $S_2$. The laser beam has the dimensions 16 mm×2.5 mm, which results in an average power density at beam emergence of approximately $1.5\cdot10^4$ W/cm$^2$. Immediately before the laser is powered on, a CNC-programmed rotational movement of the cam with a relative feed rate of the laser beam of 600 mm/min is started as well as the corresponding compensating movements of the z-axis to keep the focal distance constant as well as the y-axis to ensure the perpendicular incidence of the beam.

After the laser is powered off, the cam cools in air. Due to the fact that the temperature field of the inductive preheating at the beginning of the laser beam melting penetrates only approximately 3 mm into the cam, the self-quenching is adequate to suppress complete or coarse pearlite formation.

The result of the treatment is a 0.4 mm thick ledeburitic layer with an average hardness of 780 HV0.05. It consists of finely dispersed cementite with a thickness of approximately 1 μm, residual austenite, martensite, and bainite. The pearlite content is less than 20%. Under that, a martensitic support layer of 0.65 mm thickness follows. In it, the hardness drops continuously from 780 HV0.05 to 400 HV0.05. It consists mainly of martensite, residual austenite, bainite, and partially dissolved pearlite. The surface layers are crack-free.

Wear investigations in a lubricated friction test in comparison with specimens conventionally preheated in the furnace at 450° C. and then laser remelted using the same parameters yielded an increase in load-carrying capacity of 20%.

By varying the preheating time $t_1$ of the temperature time cycle $T^1$ to longer times and the peak temperature $T_{1max}$ to higher temperatures, the content of martensite, austenite, bainite, and pearlite can be changed. Thus, for example, it is possible without violating the concept of the invention to set even a higher pearlite content for wear loads at higher temperatures. By increasing the laser feed rate, the formation of the cementite can, moreover, be made more finely dispersed.

Figure 2:
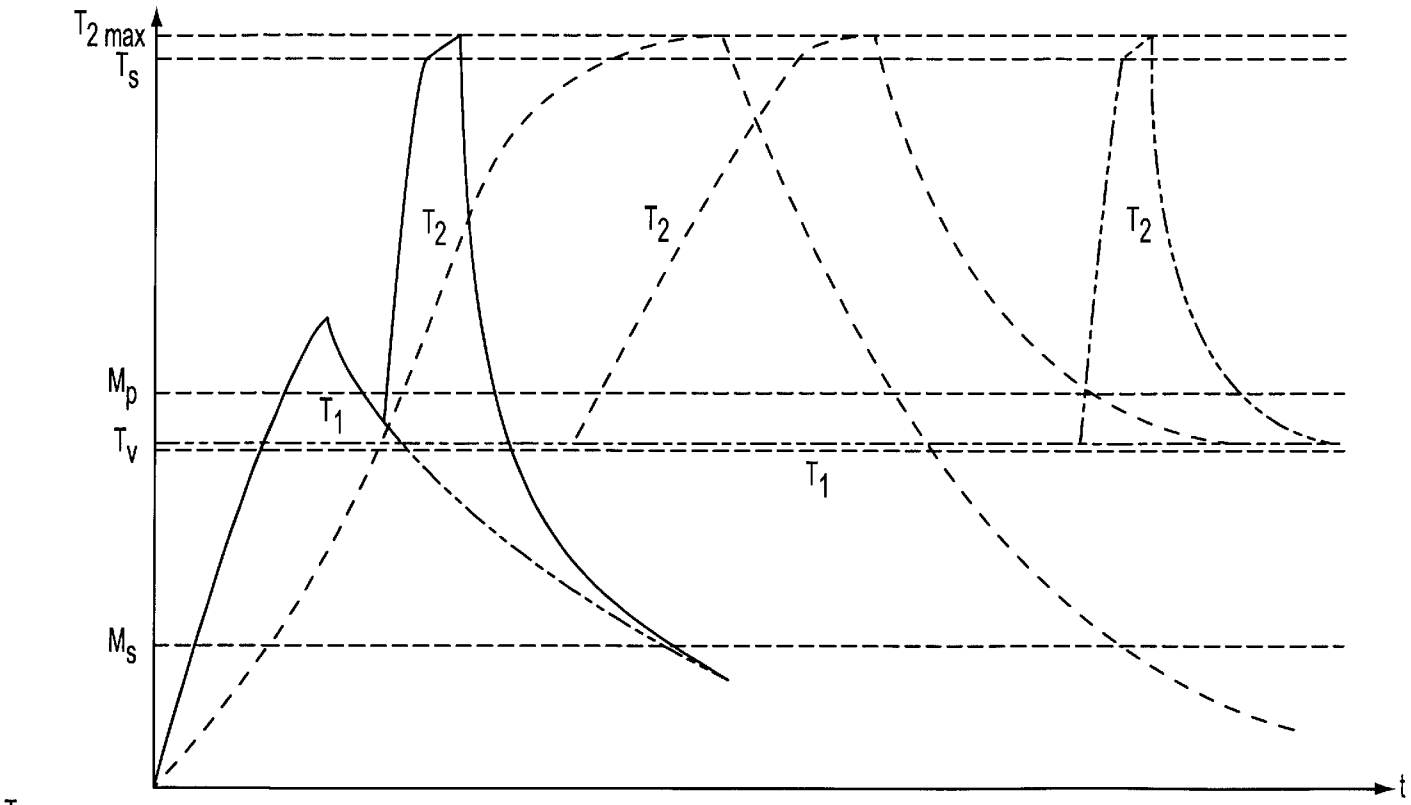

FIG. 2 compares the method according to the invention with the prior art. Conventional TIG remelting after furnace preheating (short-dashed line) has a relatively long melting pool life $\Delta t_s$, a low quenching speed $(\Delta T_{2maxa}/\Delta t_{2maxa})$ during solidification, and a low cooling speed $(\Delta T_{2a}/\Delta t_{2a})$ in the temperature range Mp of the pearlite formation. Because of the long melting pool life and the low quenching speed, the cementite formation is very coarse. The low cooling speed to the conventional preheating temperature $T_v$ in the range of the pearlite formation Mp results in a coarse pearlite because of the low temperature difference.

By eliminating the preheating, the formation of coarse pearlite can be suppressed even with TIG remelting in the temperature range Mp (long-dashed line) and a martensitic support layer can be obtained as result of the adequately fast passage through the $M_s$ point. However, this advantage is bought at the price of slow heating, a longer melting pool life and a still somewhat lower quenching speed, which results in a still somewhat coarser cementite formation.

Laser or electron beam remelting after conventional preheating (dot-dashed line) has, in contrast, very high heating speeds, low melting pool life, and high solidification and quenching speeds, which result in a finer cementite formation. Due to the high conventional preheating temperature $T_V$, however, here again, the cooling speed is so low in the temperature range Mp that relatively coarse pearlite develops.

In contrast, with the temperature cycle according to the invention (solid line), maximum heating speeds, short melting pool lives, and high quenching speeds can be combined with an adequately high cooling speed in the temperature range Mp, which enables production of optimally wear-resistant structures.

Additional advantages of the process combination according to the invention consist in that

- it is possible to do without expensive through-type preheating furnaces and in some cases cooling zones
- structures can be produced in a broader range of variation because of the short melting pool lives, improved edge accuracy is achieved, particularly in the vicinity of the tip of the cam, which reduces post-treatment expense.

What is claimed is:

1. A wear-resistant cast-iron camshaft having a surface layer comprising a ledeburitic remelted layer with a high cementite content and, lying thereunder, a martensitic hardening zone, wherein a. the remelted layer comprises finely dispersed ledeburitic cementite with thicknesses $\leqq 1$ $\mu$m and a metallic matrix of a phase mixture comprising:

a) at least one of martensite and bainite, b) residual austenite, and c) less than 20% finely laminated pearlite with a lamella distance $\leqq 0.1$ $\mu$m, and b. the hardening layer comprises a phase mixture comprising an at least one of martensite and bainite, b) partially dissolved pearlite, and c) residual austenite.

2. The wear-resistant camshaft according to claim 1, wherein the remelted layer has a depth $t_s$ of 0.25 mm$\leqq t_s \leqq$0.8 mm and the hardening layer has a depth of 0.5 mm$\leqq t_s \leqq$1.5 mm.

3. A high-energy surface remelting method for producing a wear-resistant cast iron camshaft, the method comprising:

generating a temperature time curve of pre-heating and of the remelting with two different energy sources $S_1$ and $S_2$ with different power densities $p_1$ and $p_2$, wherein the temperature time curve comprises two superposed short-time temperature time cycles $T_1$ and $T_2$; and pre-heating and remelting the surface in accordance to the temperature time curve, wherein the temperature time cycle $T_1$ has a peak temperature $T_{1max}$ of 560° C.$\leqq T_{1max} \leqq$980° C., a heating time of 0.5 s$\leqq t_1 \leqq$6 s, an average heating speed of $(\Delta T_{1maxc}/\Delta t^{1c})$ of 90 K/s$\leqq(\Delta T_{1maxc}/\Delta t_{1c})$ $\leqq$1900 K/s and an initial quenching speed $(\Delta T_{1a}/\Delta t_{1a})$ of 50 K/s$\leqq(\Delta T_{1a}/\Delta t_{1a})\leqq$500 K/s and the power density $p_1$ of the energy source $S_1$ reaches the value of $8\times10^2$ W/cm$^2\leqq p_1 \leqq 8\times10^3$ W/cm$^2$, wherein the temperature time cycle $T_2$ has a peak temperature $T_{2max}$ of $T_{2max}\geqq T_s$, whereby $T_s$ represents the melting temperature of the cast-iron used, an average heating speed $(\Delta T_{2maxc}/\Delta t_{2c})$ of 3000 K/s$\leqq(\Delta T_{2maxc}/\Delta t_{2c})\leqq$40,000 K/s, a solidification speed $v_s$, of the melt of 10 mm/s$\leqq v_s \leqq$67 mm/s as well as a power density $p_2$ of the energy source $S_2$ of $0.8\times10^4$ W/cm$^2\leqq p_2 \leqq 8\times10^4$ W/cm$^2$ is selected, a time period $t_{21}=t_2-t_1$ after the temperature time cycle $T_2$ begins is 0.3 s$\leqq t_{21} \leqq$11 s, a temperature $T_{1min}$ at which the temperature time cycle $T_z$ begins is $T^{1min}$>500° C., a melting pool life $t_s$ is in the range of values from 0.08 s$\leqq \Delta t_s \leqq$0.8s, and a feed rate $v_B$ of the high-energy energy source $S_2$ reaches the value of 600 mm/min$\leqq v_B \leqq$4000 mm/min.

4. A method for producing a high wear resistant cast iron camshaft having a remelted surface layer with a fine dispersed microstructure and an underlying supporting hardening layer, said method comprising:

a high energy short time pre-heating process of the surface near region produced by an energy source $S_1$ with the power density $p_1$ and a resulting short temperature-time cycle $T_1$;

a high energy short time surface remelting process produced by a second energy source $S_2$ with a higher power density $p_2>p_1$ and a resulting short temperature-time cycle $T_2$;

a short time period $t_{21}$, between the end of the short temperature-time cycle $T_1$ and the beginning of the short temperature-time cycle $T_2$; and a self-quenching of the heated and remelted camshaft.

5. The method in accordance with claim 4, wherein the short temperature time cycle $T_1$ has a peak temperature $T_{1max}$ of 560° C.$\leqq T_{1max} \leqq$980° C. a heating time of 0.5 s$\leqq t_1 \leqq$6 s , an average heating speed of $(\Delta T_{1maxc}/\Delta t_1 c)$ of 90 K/s$\leqq(\Delta T_{1max}c/\Delta t_{1c})\leqq$1900 K/s and an initial quenching speed $(\Delta T_{1a}/\Delta t_{1a})$ of 50 K/s$\leqq(\Delta T_{1a}/\Delta t_{1a})\leqq$500 K/s and the power density $p_1$ of the energy source S1 reaches the value of $8\times10^2$ W/cm$_2\leqq p_1 \leqq 8\times10^3$ W/cm$^2$.

6. The method in accordance with claim 4, wherein the temperature time cycle $T_2$ has a peak temperature $T_{2max}$ of $T_{2max}\leqq T_s$, whereby $T_s$ represents the melting temperature of the cast-iron used, an average heating speed $(\Delta T_{2maxc}/\Delta t_{2c})$ of 3000 K/s$\leqq(\Delta T_{2maxc}/\Delta t_{2c})\leqq$40,000 K/s, a solidification speed $v_s$ of the melt of 10 mm/s$\leqq v_s \leqq$67 mm/s as well as a power density $p_2$ of the energy source $S_2$ of $0.8\times10^4$ W/cm$^2\leqq p_2 \leqq 8\times10^4$ W/cm$^2$ is selected.

7. The method in accordance with claim 4, wherein the short time $t_{21}$ is 0.3s$\leqq t_{21} \leqq$11 s.

8. The method in accordance with claim 4, wherein a temperature $T_{1min}$ at which the temperature time cycle begins is $T_{1min}$>500° C.

9. The method in accordance with claim 4, wherein a melting pool life $t_s$ is in the range of values from 0.08 s$\leqq \Delta t_s \leqq$0.8 s.

10. The method in accordance with claim 4, wherein a feed rate $v_B$ of the high-energy energy source $S_2$ reaches the value of 600 mm/min$\leqq v_B \leqq$4000 mm/min.

11. The method of claim 4, wherein the self-quenching is carried out in air.

12. The method according to claim 4, further comprising melting the entire width of the camshaft in one rotation.

13. The method according to claim 4, further comprising generating the necessary power density distribution for the power density $p_2$ at a right angle to the feed direction by a rapid beam oscillation, wherein the oscillation frequency is at least 200 Hz.

14. The method according to claim 4, wherein the high-energy energy source $S_2$ is a laser.

15. The method according to claim 13, wherein the rapid beam oscillation comprises a rapid temporal and periodic sequence of a plurality of harmonic oscillation packets of different frequency f, amplitude A, center position $A_o$, and periodicity $n_p$, wherein the number of different oscillation packets is between 1 and 8, and periodicity is selected at $1\leqq n_p \leqq 20$.

16. The method according to claim 4, wherein the energy source $S_1$ is a medium-frequency induction generator.

17. The method according to claim 4, wherein the high-energy energy source $S_2$ is an electron beam.

18. The method according to claim 4, wherein the energy source $S_1$ is an electron beam.

19. The method according to claim 4, wherein the high-energy energy source $S_2$ is a high-performance diode laser.

20. The method according to 4, wherein the energy source $S_1$ is also a high-performance diode laser.

21. The method according to claim 20, wherein the energy source $S_1$ comprises a plurality of high-performance diode lasers arranged in rotational symmetry around the camshaft and the camshaft is preheated in the stationary process.

22. The method according to claim 3, wherein used cast iron is alloyed with cementite stabilizing elements.

23. The method according to claim 3, wherein used cast iron is alloyed with austenite stabilizing elements.

24. The method according to claim 4, wherein at least one stabilizing element selected from cementite and austenite is added during the short time surface remelting process with the high-energy energy source $S_2$.

25. A wear-resistant cast-iron camshaft having a surface layer comprising:

at least one ledeburitic remelted layer with a cementite content over at least one martensitic hardening zone;

the at least one ledeburitic remelted layer comprising finely dispersed ledeburitic cementite having a thickness of less than or equal to about 1 $\mu$m, and at least one metallic matrix of a phase mixture comprising at least one of martensite and bainite, residual austenite, and less than about 20% finely laminated pearlite with a lamella distance of less than or equal to about 1 $\mu$m; and the at least one martensite hardening zone comprising a phase mixture of at least one of martensite and bainite, partially dissolved pearlite, and residual austenite.

26. The camshaft of claim 25, the at least one ledeburitic remelted layer having a depth of greater than about 0.25 mm and less than about 0.8 mm, and the at least one hardening zone has a depth of greater than about 0.5 mm and less than about 1.5 mm.

* * * * *